United States Patent [19]

Vajtay

[11] 3,986,659

[45] Oct. 19, 1976

[54] END CAPS FOR TUBULAR CONTAINERS

[76] Inventor: Leslie Vajtay, 215 Davidson Ave., Somerset, N.J. 08873

[22] Filed: Jan. 27, 1975

[21] Appl. No.: 543,987

[52] U.S. Cl. ..... 229/43; 220/4 R

[51] Int. Cl.[2] ..... B65D 5/64; B65D 7/00

[58] Field of Search ..... 229/43; 220/4 R, 4 F, 220/306, 352, 66, 69

[56] References Cited

UNITED STATES PATENTS

| | | | |
|---|---|---|---|
| 1,745,101 | 1/1930 | Labombarde | 229/43 |
| 1,780,232 | 11/1930 | Hayman | 220/306 X |
| 3,208,620 | 9/1965 | Herdering | 220/306 X |
| 3,749,277 | 7/1973 | Kinney | 229/43 X |
| 3,913,774 | 10/1975 | Vajtay | 220/67 X |

*Primary Examiner*—William Price
*Assistant Examiner*—Steven M. Pollard
*Attorney, Agent, or Firm*—Theodore E. Galanthay

[57] ABSTRACT

Disclosed is a rigid end plug snugly inserted into a tube formed from plastic sheet material. The tube has perforations near its open ends into which axially tapered radial protrusions from the end plug are inserted. The end plug has a beveled edge for ease of snug insertion into the tube and a rim on which the tube is seated.

9 Claims, 4 Drawing Figures

END CAPS FOR TUBULAR CONTAINERS

CROSS REFERENCE TO RELATED APPLICATION OR PATENT

L. Vajtay co-pending application Ser. No. 340,400, filed Mar. 12, 1973.

BACKGROUND OF THE INVENTION

1. Field of the Invention

This invention relates to rigid end plugs for tubular containers and more particularly to axially inserted rigid end plugs forming locking closures and providing rigidity and strength to tubular containers formed from sheet material.

2. Description of the Prior Art

In my above mentioned co-pending application entitled: "End Caps For Containers And Their Manufacture," I previously described that it is known in the packaging art to fabricate tubular containers having flexible sides and rigid end caps. The flexible sides are normally a thermo-plastic material approximately 0.010 to 0.050 inches in thickness, and manufactured in the form of a tube. The tube may be given any desired cross-sectional shape such as an ellipse, circle, or polygon, and is then held techniques the desired shape by the rigid end caps. Various tecnhiques have been employed in the joining of rigid end caps to the flexible sides including the use of adhesives, tape, staples and other fastening materials. Another known technique is to provide an end cap structure for frictionally engaging the thin flexible sides. In most applications, however, frictional engagement is inadequate and a positive locking engagement is required. There is no known prior art technique suitable for providing a container of the type disclosed herein that is either permanently closed or easily reopenable. Moreover, prior art manufacturing techniques do not lend themselves to a one-step assembly by either hand or machine, for providing a positive engagement between flexible sides and rigid end caps.

In my above named co-pending application, I disclosed a revolutionary end cap structure in which opposed camming surfaces firmly locked into the perforations of an axially inserted tube. In some applications, however, it is desirable to use locking means other than the previously disclosed opposed camming surfaces.

SUMMARY OF THE INVENTION

Accordingly, it is an object of this invention to provide an improved rigid end plug for a tubular container formed from plastic sheet material.

It is a further object of this invention to provide a rigid end plug axially insertable into a tubular container with the design flexibility of being locked permanently or reopenable.

Lastly, it is an object of this invention to provide an improved package.

In accordance with the present invention, a flexible thermo-plastic material is utilized for the sides of a container. This material can be sheets of poly-vinyl chloride (p.v.c.), oriented poly-styrene (o.p.s.) or any other flexible, semi-rigid sheet material. The sheets may be pre-extruded, extruded or calendared to a thickness of approximately 0.010 inches, and adhesively joined along a longitudinal seam, forming tubes. The sheets or tubes may also be creased along a predetermined number of edges, to form a container with a polygon cross-section, such as a rectangle, for example. The resultant creased tubular member is then cut into desired lengths, depending on the size of the container to be fabricated. Perforations are punched near the ends for interlocking with the end caps.

The end caps are formed from a plastic material, usually by molding, and result in rigid end members providing strength to the entire container. The dimensions and shape of the end caps conform to the dimensions and shape of the flexible sides. The end caps have a base portion, substantially forming the end covers for the container and side walls. The end caps also have engaging means for interlocking with the perforations in the flexible sides thereby providing a positive lock for holding the container together.

The base portion of the end plug is extended slightly (an amount approximately equal to the thickness of the tubular material), forming a rim to seat the tube. The base portion also has an axially extending peripheral flange or wall. The outer surface of the flange has a cross-sectional area substantially equal to the interior cross-sectional area of the tube and has a beveled rim for insertion into the tube forming a relatively tight fit. The flange also has a plurality of axially tapered radial protrussions stressing the tubular material until they snap into perforations in the tube forming a lock. A still further feature of the present invention is an indentation under the protrusions (including an interruption in the rim of the base) permitting the insertion of an object between the tube and end plug to open the package non-destructively.

The package of the present invention is uniquely assemblable by either hand or machine because the end cap locks to the tubular member without the need for adhesives, tape, staples, or any other fastening material and without a secondary operation. During the assembly process, the perforations and engaging means are virtually self-aligning, completing the package when the engaging means interlocks with the perforations.

The above mentioned objects, features and advantages of the invention, together with others inherent in the same, are attained by the embodiments illustrated in the drawings, the same being merely preferred exemplary forms, and are described more particularly as follows.

IN THE DRAWINGS

FIG. 1 is a partially exploded perspective view of a container in accordance with the present invention.

FIGS. 2, 3, and 4 are alternate embodiments of the present invention.

DETAILED DESCRIPTION

Figure 1:
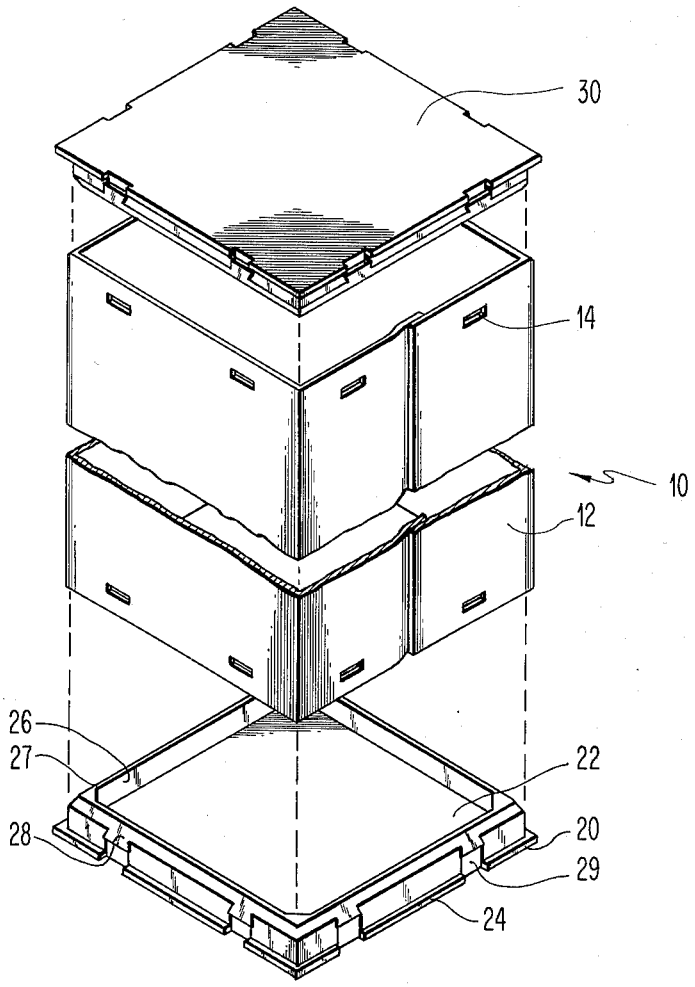

Referring to FIG. 1, container 10 includes tubular central portion 12 and end caps 20 and 30. Tube 12 has perforations 14 near its open ends. It is an important feature of this invention that tube 12 is formed from a sheet material such as thin plastic in the order of 0.010 inches in thickness, essentially incapable of maintaining its cross-sectional shape without the rigid end caps.

Rigid end caps (or plugs) 20 and 30 are preferably molded rigid plastic much heavier than the tubular material, providing strength and rigidity to the assembled package. End cap 20 has a base 22 which is extended around at least portions of the periphery forming rim 24 which is dimensioned approximately equal to the thickness of tube 12.

Axially extending flanges 26 having an outer surface with a cross-sectional area substantially equal to the cross-sectional area of the inner surface of tube 12 are arranged as shown. Rim 27 of flanges 26 has a beveled edge to provide a friction fit into tube 12. Arrowheads 28 are axially tapered radial protrusions formed on the outer surface of flange 26. As the end plug is inserted into tube 12, arrowheads 28 further stress the open end of tube 12 which snaps in place when the protrusions enter the corresponding perforations. Note that these protrusions are not only axially tapered for ease of insertion, but also have another surface substantially perpendicular to flange 26 for locking the package. It is here noted that the dimensions and positioning of perforations 14, arrowheads 28, and rim 24 are arranged to provide a snug fit as shown, and seat tube 12 on rim 24.

In order to provide a non-destructively disassemblable package, indentations 29 in flange 26 are provided. These permit the intentional prying up of the tubular material for re-opening the package. Note that rim 24 is also discontinued at these points for the same purpose and also to facilitate manufacture.

As further illustrated in FIG. 1, perforations 14 are located near the corners as this provides the most secure lock. A lock near the middle between two corners provides a greater chance for the tubing to pop out inadvertantly and might require further precautions as illustrated in my co-pending application, or as described in greater detail herein below. At any rate, since perforations are preferably made in the sheet material while it is still folded flat, perforations will be made in pairs as illustrated in FIG. 1.

Figure 2:
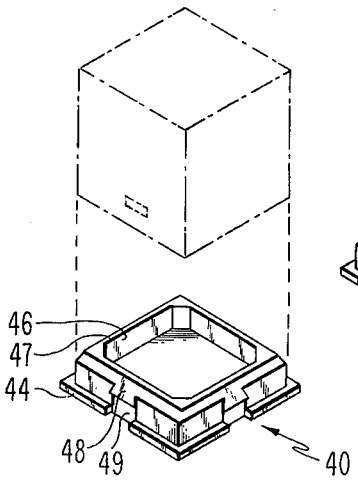

In the alternate embodiment of FIG. 2, end cap 40 has arrowheads 48 on flange 46 placed away from the corners. For this reason they are much larger relative to the length of the flange to permit relatively secure locks. Note rim 44, beveled edge 47 and indentation 49 provided for the same purpose as corresponding elements in end cap 20.

Figure 3:
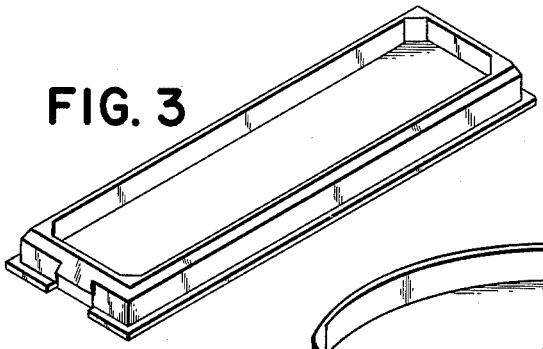
Figure 4:
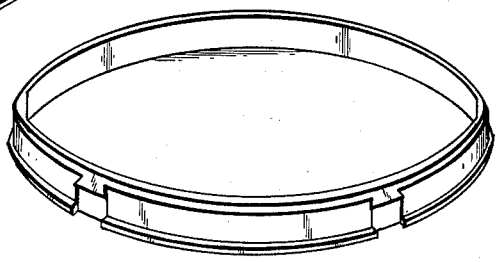

FIG. 3 illustrates a still further embodiment in which a rectangular cross-section having two relatively short sides can provide suitable locks merely on the two short sides. Note that the arrowhead again is large with respect to the size of the flange, as in the FIG. 2 embodiment. FIG. 4 illustrates that this invention is adaptable to shapes other than rectangles. The key is that the rigid plug is axially insertable into the tube to form a locked container.

While several examples illustrative of preferred embodiments have been described, those skilled in the art will recognize that various changes in the disclosed structures and exemplary methods may be made without departing from the spirit and scope of this invention.

I claim:

1. A tubular package comprising:

a tubular central section formed from sheet material and having at least a pair of perforations near an open end;

a rigid end plug having a base with a rim portion and an axially extending peripheral flange frictionally inserted into said tubular central section said flange having indentations to permit the opening of said package; and axially tapered radial protrusions formed on said flange and inserted into said perforations when said tubular central section is seated on said rim.

2. A tubular package as in claim 1 wherein said flange further comprises:

beveled edges for facilitating insertion of the end plug into said tubular central section.

3. A tubular package as in claim 1 wherein said rim is eliminated in the vicinity of said indentations.

4. A tubular package as in claim 1 wherein said protrusions simultaneously flex said tubular central section radially.

5. A tubular package as in claim 1 wherein said protrusions are positioned near the corners.

6. A tubular package comprising:

a tubular central section formed from a flexible sheet material adhesively joined along a longitudinal edge and having at least a pair of perforations near an open end;

a rigid end plug having a base with a rim portion and an axially extending peripheral flange frictionally inserted into said tubular central section; and axially tapered radial protrusions formed on said flange for deforming said tubular central section when said rigid end plug is first inserted into said tubular central section, said protrusions being inserted into said perforations when said tubular central section is seated on said rim, permitting said tubular central section to return to its original cross-sectional shape.

7. A tubular package as in claim 6 wherein said flange comprises:

beveled edges for facilitating insertion of the end plug into said tubular central section.

8. A tubular package as in claim 6 wherein said protrusions simultaneously flex said tubular central section radially.

9. A tubular package as in claim 6 wherein said protrusions are positioned near the corners.

* * * * *